US005230117A

United States Patent [19]

Johnson et al.

[11] Patent Number: 5,230,117

[45] Date of Patent: Jul. 27, 1993

[54] GOLF SHOE AND GOLF CLUB CLEANING DEVICE

[76] Inventors: Ronald W. Johnson, 117 Hughes Ave., Pawtucket, R.I. 02861; Robert N. Johnson, 98 Owen Ave., Pawtucket, R.I. 02860-1520

[21] Appl. No.: 859,035

[22] Filed: Mar. 27, 1992

[51] Int. Cl.[5] ..... A46B 9/08

[52] U.S. Cl. ..... 15/106; 15/161; 15/200; 15/DIG. 6; 242/107; 273/32 B

[58] Field of Search ..... 15/106, 160, 161, DIG. 6, 15/200; 248/110-112, 579; 273/32 B; 242/107, 107.6

[56] References Cited

U.S. PATENT DOCUMENTS

| | | | |
|---|---|---|---|
| 200,218 | 2/1878 | Nicholson | 15/106 X |
| 1,262,005 | 4/1918 | Bell | 242/107 |
| 1,524,421 | 1/1925 | Brady | 15/160 X |
| 1,541,197 | 6/1925 | Stein | 15/106 |
| 2,631,323 | 3/1953 | Seelenbinder | 15/200 X |
| 2,636,751 | 4/1953 | Carlson | 242/107 X |
| 2,732,148 | 1/1956 | Lummis | 242/107 |
| 2,887,121 | 5/1959 | Magee | 242/107 X |
| 3,047,896 | 8/1962 | Gunderson | 15/160 X |
| 3,062,478 | 11/1962 | Adachi | 242/107 |
| 3,350,736 | 11/1967 | Frazelle et al. . | |
| 4,167,796 | 9/1979 | De Pamphilis | 15/106 X |
| 4,350,457 | 9/1982 | Carnahan | 273/32 B X |
| 4,670,932 | 6/1987 | Williams | 273/32 B X |
| 5,056,946 | 10/1991 | Larkin | 273/32 B X |
| 5,075,918 | 12/1991 | Zeltner et al. | 15/114 X |

FOREIGN PATENT DOCUMENTS

| | | | |
|---|---|---|---|
| 988256 | 8/1951 | France | 15/106 |
| WO91/01777 | 2/1991 | PCT Int'l Appl. | 273/32 B |
| 184257 | 11/1936 | Switzerland | 15/106 |

*Primary Examiner*—Stephen F. Gerrity
*Attorney, Agent, or Firm*—Barlow & Barlow, Ltd.

[57] ABSTRACT

A golf shoe and golf club cleaning device particularly adapted for attachment to a golf bag or other convenient surface. The device includes a brush handle having soft bristles embedded in one face thereof and stiff bronze bristles embedded in an end wall that extends out of the general longitudinal extent of the handle at an angle thereto. The handle is tethered to a golf bag by a spring loaded cable that retracts into a casing and the cable is removably attached to a golf bag. By this arrangement, the brush is securely fastened to the golf bag or other convenient surface during normal play.

3 Claims, 2 Drawing Sheets

GOLF SHOE AND GOLF CLUB CLEANING DEVICE

BACKGROUND OF THE INVENTION

This invention relates to a portable cleaning device for golf shoes and golf clubs that is adapted to be releasably attached to a golf bag or other convenient surface and be retained thereon by a chain and reel.

In the prior art there are a number of golf cleaning devices for shoes and more particularly for the cleats which include brushes and cleat mud scrapers as, for example, in the Frazelle, et al patent, U.S. Pat. No. 3,350,736. This particular device is arranged to additionally carry a towel and to be tethered to the handle of a golf bag by a thong. Utilizing a device of this nature, or utilizing an individual scraper does not allow the user to easily clean his cleats and then be assured that the device will be easily available for use without reaching into a pocket on the golf bag. There remains a need for a device capable of cleaning golf shoes and cleats and yet will be attached to a golf bag or other convenient surface in such a way that it will always be retained on the outside available for use. There is also a need for a device which will clean a club face. For example, club faces are configured with a series of scoring lines and a surface finish which enables a golfer to impart a desired spin to the ball when properly struck. It is of course recognized that a club face and particularly the scoring line, should be kept clean.

SUMMARY OF THE INVENTION

There is provided a cleaning device that consists of a soft brush and a wire brush which are affixed to a handle that in turn is attached to a chain and the chain is retained in a reel housing, which reel will be spring coiled so that the chain will be automatically retracted into the reel. This satisfies the need for a cleaning device that is capable of a variety of cleaning operations including not only cleats on golf shoes but also the cleaning of golf clubs which is releasably attached to a golf bag. Accordingly, it is the principal object of the present invention to provide a device of this type which meets these needs and in its more preferred aspect, provides other desirable attributes and advantages.

DESCRIPTION OF THE INVENTION

Figure 1:
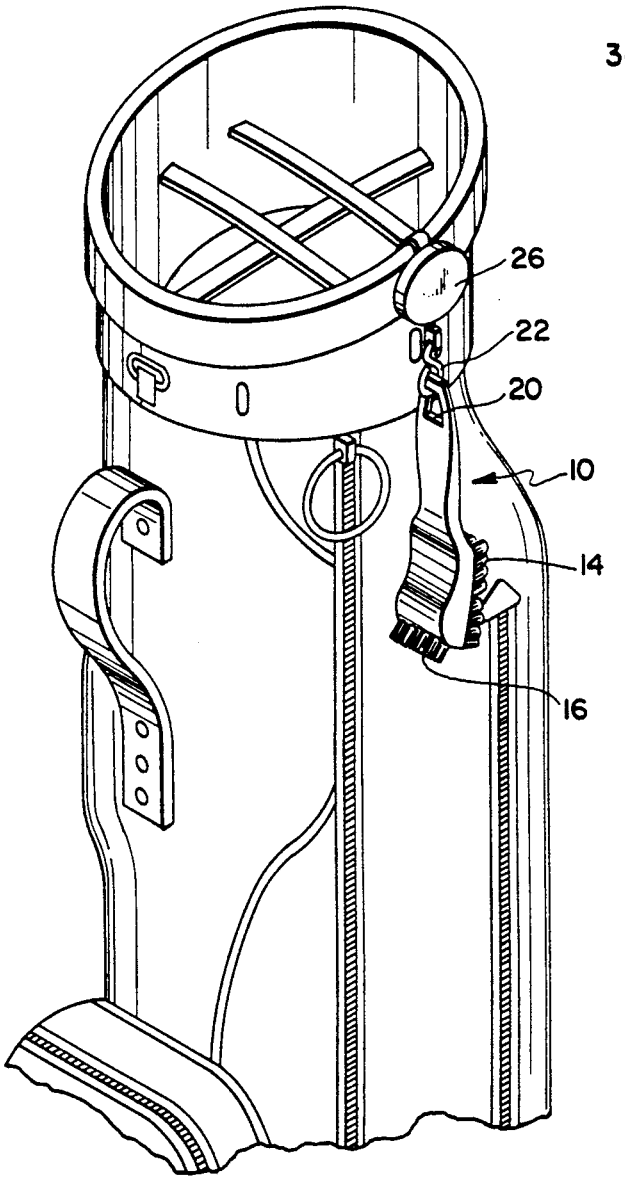
FIG. 1 is a perspective view showing one embodiment of the cleaning device of the invention attached to the top of a golf bag.
Figure 3:
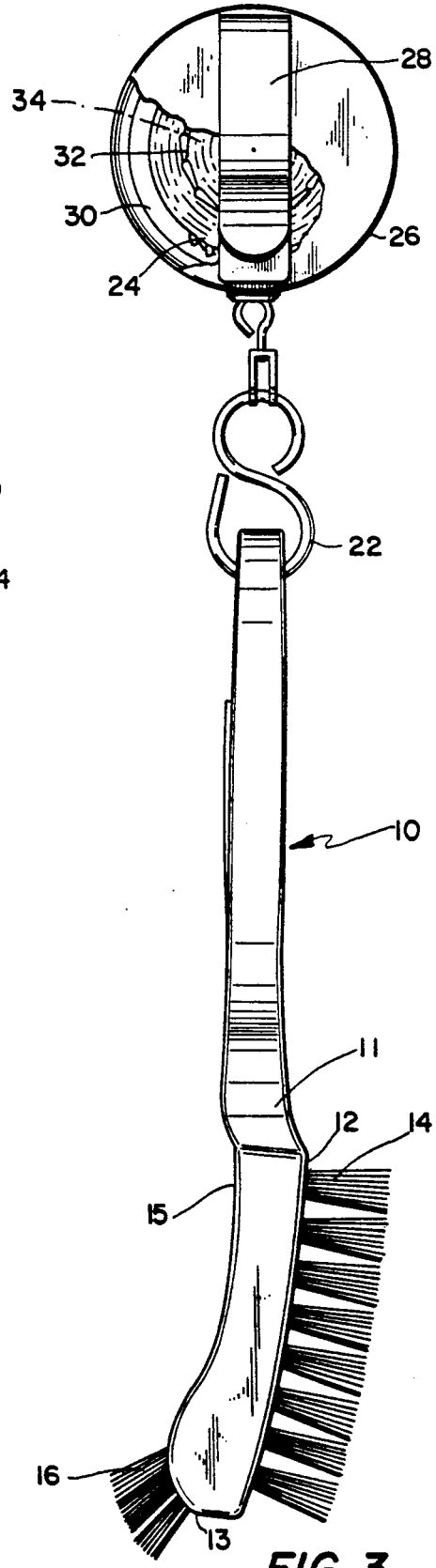
FIG. 3 is a plan view of the cleaning device.
Figure 2:
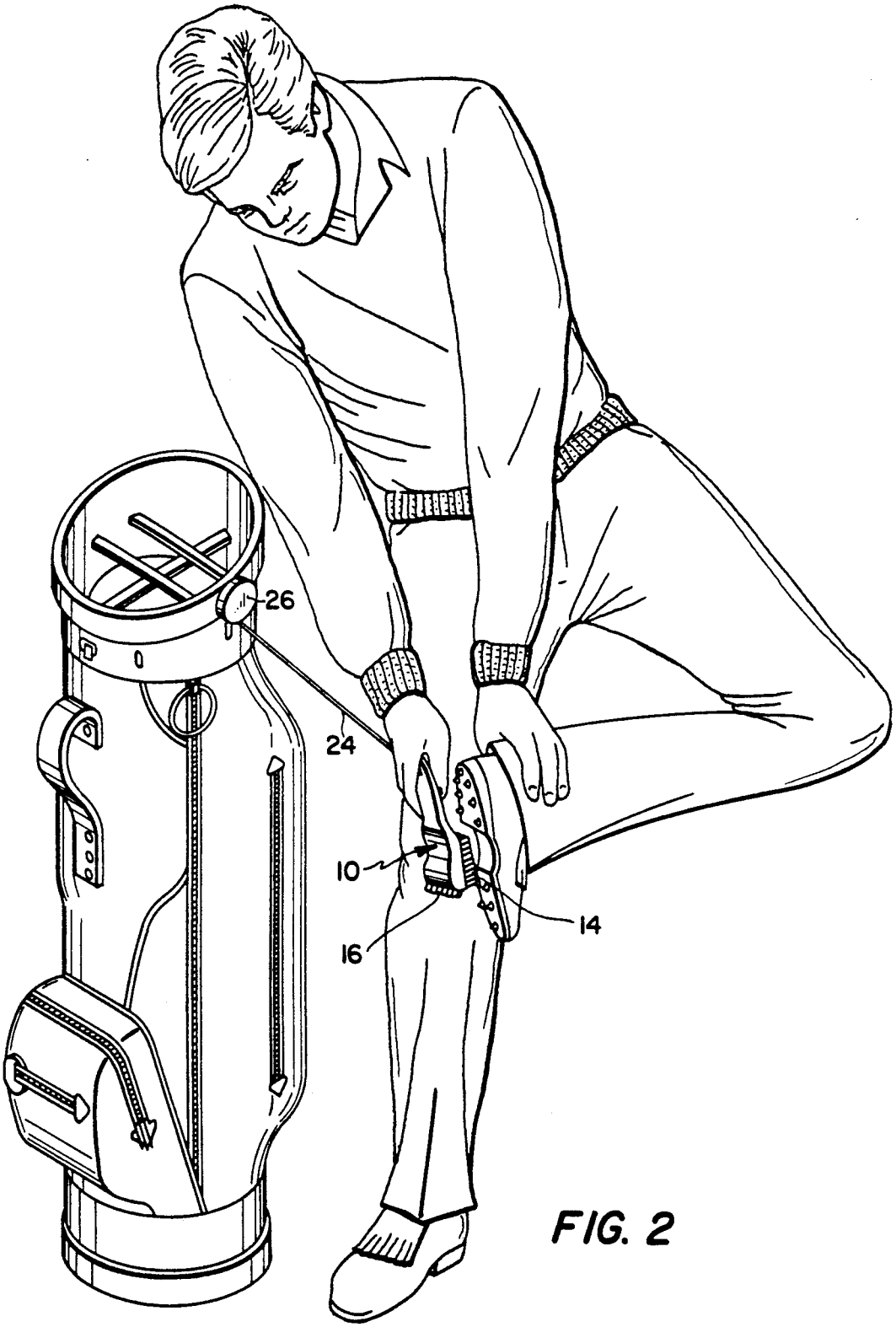
FIG. 2 is a diagrammatic view illustrating the device in use.

Referring to the drawings, it will be seen that the shoe and club cleaning device, according to this invention, is generally indicated at 10 and comprises a body portion 11 which on the front face 12 and at a first end thereof carries synthetic or natural brush bristles 14 which are secured within the body of the handle. Extending from the end wall portion 13 of the upper face of the handle are a plurality of wire bristles 16 which are secured within the handle. According to the illustrated embodiment, the brush bristles 16 are attached to the convex portion 13 of the back face of the handle body 11. The brush 16 is formed of stiff bronze wire bristles that are held within the molded body portion 11. The end wall 13 of the body portion 11 slants towards the upper face 15 of the body portion 11 at an angle of approximately 30°, sufficient to allow free access to the bronze wire bristles 16 and not interfere with the bristles 14. Preferably they are stiff nylon bristles which are held in the front face 12 of the body portion 11 as well known to those skilled in the art, and are comprised of a plurality of groups of bristles, for example forty eight tufts of bristles.

The handle includes an aperture 20 at the second end thereof opposite the bristles to which a ring 22 is attached, which ring then is secured to the end of a chain 24 which passes through and is normally stored within a casing 26 that carries on one face thereof a clip 28. Within the casing is a reel 30 having a hub 32 to which the chain is fastened. A spiral spring 34 is disposed within the hub and is connected to the reel to maintain the ring in contact with the case 26. The retaining means, in the form of the clip 28 comprises a U-shaped clip having one flat portion attached to the rear face of the chain housing and this clip is preferably configured to neatly conform to the conventional beaded upper edge of a golf bag wall. The retaining means may also include any means suitable for removably attaching the device of the invention to another convenient and suitable surface such as a portion of the golf cart or any other accessory used during a golf game.

When the cleaning device attached to the chain is to be used, the chain may be drawn away from the housing by simply pulling it outwardly. The reel will rotate to permit the chain to be drawn outwardly to the desired extent. Upon release of the gripping of the cleaning device, the spring will rotate the reel and rewind the chain upon the spool and pull the brush back into position, hanging off the edge of the golf bag. The cleaning device has an attractive appearance and has the advantage that it permits extension by the chain by merely pulling on the handle of the cleaning device and the chain will be automatically retracted, keeping the brush ready for the next use.

It is obvious that minor changes may be made in the form and construction of the invention without departing from the material spirit thereof. It is not, however, desired to confine the invention to the exact form herein shown and described, but it is desired to include all such as properly come within the scope claimed.

We claim:

1. A golf shoe and golf club cleaning device comprising:

a longitudinally extending brush handle having a first end and a second end, the first end having an upper face and a lower face, the lower face including a generally flat portion, the upper face including a convex portion and a generally flat portion paralleling the generally flat portion of the lower face;

soft bristles embedded in the generally flat portion of the lower face and extending in a direction substantially transverse to the longitudinal axis of the handle;

wire bristles embedded in the convex portion of the upper face and extending at an acute angle to the longitudinal axis of the handle and extending in a direction generally opposite to the direction in which the soft bristles extend;

the handle having an aperture through the second end;

a chain having a first end and a second end with the first end of the chain secured to the handle through the aperture;

a casing for storing the chain, the casing containing a reel with the second end of the chain connected to the reel, the reel being spring coiled within the casing to urge the reel in a direction to wind the chain thereon, the casing having retaining means affixed thereto for removably attaching the casing to a convenient surface.

2. The device of claim 1 wherein said retaining means is a generally U-shaped clip means.

3. A golf shoe and golf club cleaning device comprising:

a casing having an aperture therethrough and containing a reel within the casing, an elongated flexible element wound onto the reel and extending outwardly through the aperture, the casing further including means for reeling in the elongated flexible element onto the reel after the elongated flexible element has been reeled out by the application of a manual withdrawing force to the elongated flexible element;

a brush handle including a longitudinally extending body member having a front face and a back face, the front face having a plurality of nylon bristles embedded therein, the back face including a convex portion with a plurality of bronze bristles embedded in the convex portion and wherein the bronze bristles extend at an acute angle to the longitudinal axis of the body member and away from the nylon bristles; and the body member further having means for attachment to the elongated flexible element.

* * * * *